United States Patent [19]

Starr

[11] Patent Number: 5,058,561

[45] Date of Patent: Oct. 22, 1991

[54] POPGUN FOR CYLINDRICAL PROJECTILES

[76] Inventor: Harvey Starr, 1717 Fifth Ave., San Diego, Calif. 92101

[21] Appl. No.: 512,170

[22] Filed: Apr. 20, 1990

[51] Int. Cl.[5] ..... F41B 11/12; F41B 11/34

[52] U.S. Cl. ..... 124/65; 124/64

[58] Field of Search ..... 124/55, 56, 63, 64, 124/65, 66, 67, 74

[56] References Cited

U.S. PATENT DOCUMENTS

| | | | |
|---|---|---|---|
| 134,048 | 12/1872 | Giffard | 124/56 X |
| 1,803,366 | 5/1931 | Stetson | 124/67 X |
| 2,315,242 | 3/1943 | Briggs et al. | 124/65 X |
| 2,425,866 | 8/1947 | Conklin | 124/65 |
| 2,600,883 | 6/1952 | King | 124/63 |
| 2,725,048 | 11/1955 | Koogle | 124/74 X |
| 4,850,329 | 7/1989 | Taylor et al. | 124/66 X |

FOREIGN PATENT DOCUMENTS

| | | | |
|---|---|---|---|
| 467595 | 8/1950 | Canada | 124/65 |

*Primary Examiner*—Peter M. Cuomo
*Assistant Examiner*—John Ricci
*Attorney, Agent, or Firm*—Frank D. Gilliam

[57] ABSTRACT

A compressed air gun having a piston and cylinder combination for launching cylindrical objects therefrom. The compressed air gun has a smooth bore elongated hollow cylinder which receives an elongated ribbed piston therein. The piston is slightly longer than the cylinder and extends from one end thereof. The end of the piston within the cylinder has a resilient seal which rubs against the inner wall of the cylinder and provides an air tight seal therebetween. The projectile is in the form of a cylinder such as a beverage can. A seal ring is placed around the distal end of the projectile when the projectile is inserted in the downstream end of the cylinder. The seal around the projectile extends inwardly past an angled surface in the distal end of the cylinder forming an air tight seal therewith. The angle surface provides ease of projectile insertion into the cylinder. For projectile launching the piston is translated relative to the cylinder away from the distal end of the cylinder, a projectile with the seal ring is then inserted into the distal end of the cylinder and the piston is translated relative to the cylinder in the opposite direction toward the projectile compressing the air trapped therein to an elevated pressure launching the projectile.

16 Claims, 1 Drawing Sheet

POPGUN FOR CYLINDRICAL PROJECTILES

BACKGROUND OF THE INVENTION

The invention is directed to compressed air guns and more particularly to toy pop-guns used for the launching of cylindrical projectiles such as empty beverage cans and the like.

Air guns for launching frusto conic projectile, such as, corks and spheres, such as, ping pong balls, and the like are well known in the toy art.

Generally stated, spheres or frusto conic projectiles such as corks and the like are suitable for use in compressed air guns because the projectile has only one line of contact with the launching surface of the air gun "barrel" and as the pressure within the barrel is increased the pressure will build up until the contact friction at the seal between the projectile and the barrel launch surface is overcome and then the projectile will be launched therefrom. Because there is a continuing line of friction along a cylindrical projectile and the inner surface of the launching barrel, cylindrical projectiles generally fall from the barrel under built up pressure rather than be launched therefrom.

Applicant knows of no prior art manually manipulated compressed air gun device that is capable of launching a cylindrical projectile such as an empty beverage can or the like in the same manner as a sphere or frusto conic projectile. A considerable amount of pleasure can be derived from a manually manipulated air gun that can launch cylindrical projectiles such as beverage cans in the same manner as the launching of cork and sphere projectiles from the prior art devices.

SUMMARY OF THE INVENTION

The manually operated air gun of the invention comprises a long hollow cylindrical tube forming a cylinder or gun barrel constructed of plastic or the like with an optional external support handle intermediate the ends of the cylinder and approximately normal to the longitudinal center line thereof to form a handle, a piston constructed of plastic or the like for insertion into the cylinder and translatable relative thereto, a piston to cylinder first compressed air seal positioned on the inside cylinder end of the piston whereby when the end of the cylinder adjacent to the air seal is closed and the piston is translated air is compressed within the cylinder forward of the air seal.

The cylindrical projectile for closing the cylinder end and launching therefrom is in the form of a beverage can used for containing fruit juice, soft drinks, beer, etc. In one embodiment of the invention a second "O" ring pressure seal is positioned over the external or distal end of the projectile prior to the prcjectile's insertion into the distal end of the cylinder. The "O" ring forms a pressure seal with the inside end surface of the cylinder. The cylinder end adjacent to the "O" ring mating surface is angled inwardly away from the distal end of the cylinder. The angle is in the range of between 40 to 50 degrees relative to a longitudinal center line through the cylinder with substantially 45 degrees being ideal. This angle provides ease of insertion of the projectile into the end of the cylinder. In a second embodiment the cylindrical projectile carried "O" ring mates with a groove on the inner surface of a rigid end cap placed over the end of the cylinder. In operation, the piston seal end is translated away from the distal end of the cylinder sufficiently to provide sufficient air therein for compression and launch of the projectile, the projectile is then inserted into the distal end of the cylinder with the "O" ring forming a circumferential substantially single line frictional seal with the angled distal end of the cylinder forming a pressure seal therewith and translating the piston toward the projectile until sufficient air pressure is developed within the cylinder between the piston and the projectile to overcome the friction seal between the "O" ring and the cylinder end whereby the projectile is launched from the cylinder.

An object of this invention is to manually launch a cylindrical projectile from the cylinder of a compressed air gun.

Another object of this invention is to provide a cylinder and piston combination that is manually operated to launch a cylindrical projectile from the cylinder.

Still another object of this invention is to provide a manually operated air gun for launching beverage cans therefrom.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

DETAILED DESCRIPTION OF THE PREFERRED EMBODIMENTS OF THE INVENTION

Figure 1:
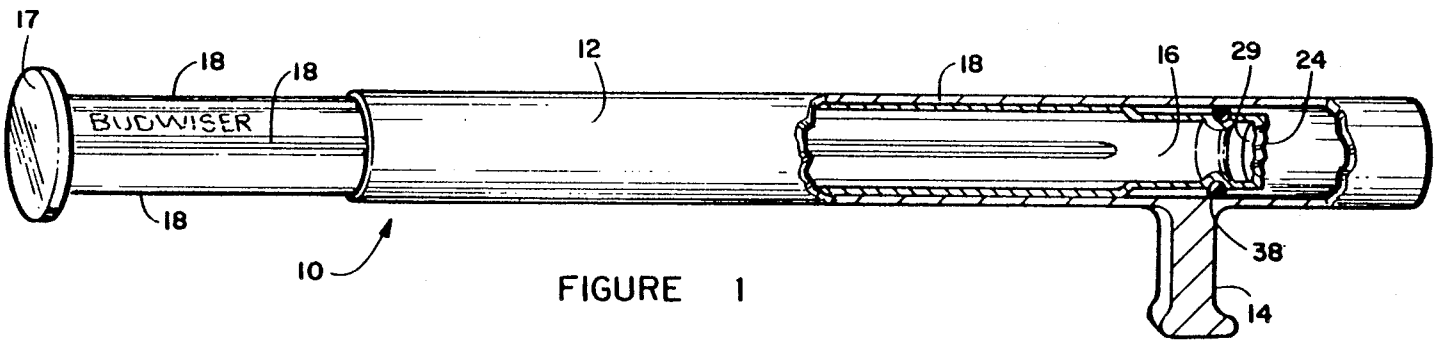
FIG. 1 depicts a perspective showing partially in cutaway of the cylindrical manually operated air-gun of the present invention.

Referring now to the various drawing Figures, and particularly to drawing FIG. 1 which depicts a perspective showing the air gun 10 of the present invention. The air gun 10 comprises a cylindrical barrel or cylinder 12 with a handle 14 for gripping and supporting the operation of the air gun of the invention. The handle 14 is fixedly attached to the cylinder 12 or may be formed as an integral part thereof. The cylinder and handle may be formed of PVC plastic or a like material which is suitable for the purpose herein after described in more detail. A plunger or piston 16 having a enlarged end surface 17. The plunger being translatable within the cylinder 12 by manually forcing the plunger into the cylinder by applying force to the enlarged end surface. The piston includes a plurality of rib protrusions 18 are spaced therearound and extend longitudinally therealong.

Figure 2:
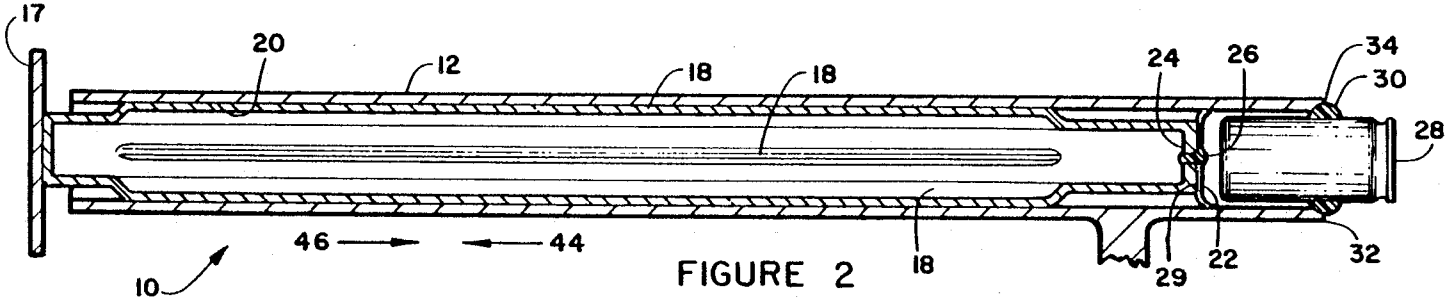
FIG. 2 is a cutaway showing of a first embodiment of the present invention.

Referring now specifically to drawing FIG. 2 which depicts a cutaway showing of a first embodiment of the invention. In this Figure the mating relationship of the plunger or piston 16 and the cylinder 12 are shown. The ribs 18 positioned along piston 16 are shown as having a close relationship with the inner wall 20 of the cylinder, It should be understood that the snug fit of the ribs allows the piston to be guided substantially linearly when translated within the cylinder. A flexible pressure seal 22 is positioned at the inner most end 24 of the piston. The seal is fixedly attached to the end of the piston by any convenient means. A screw 26 is shown for attaching the pressure seal to the piston innermost end 29 for the purpose of explanation and not by way of limitation.

Inserted in the end of the cylinder is a cylindrical projectile 28 in the form of a beverage container or can. Either the closed or open end an empty beverage can is inserted into the cylinder. A resilient "O" ring seal 30 is forced onto the surface of the beverage container adjacent to the distal or open end surface 32 and when installed grips the can surface with sufficient strength that prevents its translation during sufficient pressure build up to properly launch the projectile during operation of the air gun 10. The distal end surface 34 of the cylinder 12 is slanted inwardly at location 36 to provide ease of insertion of the projectile into the end of the cylinder. An angle in the range of 40 to 50 degrees has been found to be satisfactory for practicing the invention. An angle of substantially 45 degrees is an ideal angle.

Figure 3:
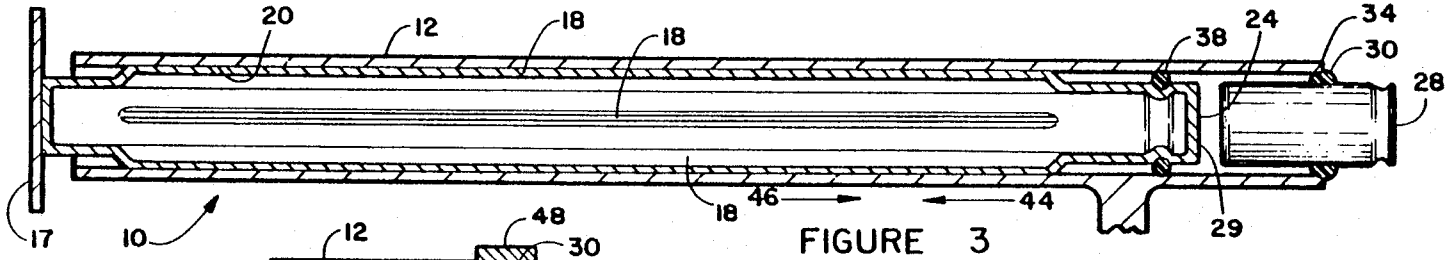
FIG. 3 is a cutaway showing of a second embodiment of the present invention.

Referring now to drawing FIGS. 1 and 3 which depicts a cutaway showing of a second embodiment of the invention. This embodiment is identical in construction and operation as the first embodiment explained above and in drawing FIG. 2 except the resilient pressure seal 22 is replaced by a second resilient "O" ring 38 which is stretched over the piston and ribs and positioned in a groove 42 positioned adjacent to the distal end of the piston.

In operation with the beverage can removed the piston is partially withdrawn by pulling the enlarged end 17 away from the cylinder along arrow 44, the projectile 28 is inserted into the distal end of the cylinder with the "O" ring 30 forced against the angled distal end of the cylinder. The amount of force to which the "O" ring and angled distal end of the cylinder are subjected determines the amount of air pressure build up required to launch the projectile from the end of the cylinder. Trial and error by the operator of the air gun determines the amount of pressure desired. The force is then applied to the enlarged head in the direction of arrow 46 compressing the air trapped between the piston seal and the projectile "O" ring seal with the cylinder. When sufficient pressure is built up to overcome the friction between the "O" ring on the projectile and the cylinder end the projectile will be launched in the direction of arrow 46. The above operation can be operated again and again for projectile launch.

Figure 4:
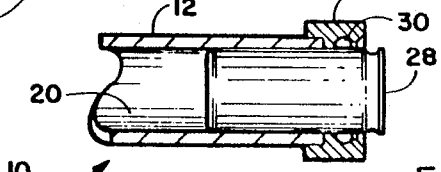
FIG. 4 is a cutaway showing of a third embodiment of the invention showing a portion of the cylinder with the projectile ready for launching.

Referring now to drawing FIG. 4 which depicts a second embodiment of the cylinder to projectile seal. In this embodiment a similar "O" ring 30 is carried by the cylindrical projectile and a rigid cap member 48 is attached to the distal end of the cylinder 12. The cap 48 has an internal circumferential groove which mates with the "O" ring forming a seal therewith similar to the seal described above.

While there have been shown and described preferred embodiments of the air-gun in accordance with the invention, it will be appreciated that many changes and modifications may be made therein without, however, departing from the essential spirit thereof.

What is claimed is:

1. A manually operated air gun for launching projectiles therefrom comprising:

a hollow cylinder having a piston insertable end and a distal end;

a piston with a plurality of spaced apart ribs therearound extending longitudinally thereof for translation within said hollow cylinder, said piston being insertable into said piston insertable end of said cylinder, said piston having a first end within said cylinder and a second end extending external of said insertable end of said cylinder;

a first sealing means for continually pressure sealing said first end of said piston to the said cylinder as said piston is translated relative thereto;

a cylindrical projectile for insertion into said distal end of said cylinder for launching from said cylinder; and a second sealing means to seal said projectile to the second end of said cylinder when inserted therein.

2. The invention as defined in claim 1 wherein said cylinder further includes an external handle for supporting and aiming said air gun during the operation of said piston translation.

3. The invention as defined in claim 1 wherein said first sealing means is fixedly attached to said first end of said piston for engaging the walls of said hollow cylinder.

4. The invention as defined in claim 3 wherein said first seal is in the form of a circle.

5. The invention as defined in claim 1 wherein said first seal is attached to said piston adjacent to the first end thereof for engaging the walls of said hollow cylinder.

6. The invention as defined in claim 5 wherein said first seal is an "O" ring.

7. The invention as defined in claim 1 wherein said cylindrical projectile is a beverage can.

8. The invention as defined in claim 1 wherein said second sealing means is an "O" ring.

9. The invention as defined in claim 8 wherein the distal end of said cylinder is angled to form a line seal with said "O" ring.

10. The invention as defined in claim 9 wherein said angel is in the range of 40 to 50 degrees.

11. The invention as defined in claim 9 wherein said angle is substantially 45 degrees.

12. The invention as defined in claim 1 wherein said distal end of said cylinder is angled from the end surface toward the longitudinal center line of said cylinder.

13. The invention as defined in claim 12 wherein said angle is substantially 45 degrees.

14. The invention as defined in claim 12 wherein said angle is in the range of 40 to 50 degrees.

15. The invention as defined in claim 1 wherein said second sealing means is carried by said cylindrical projectile.

16. The invention as defined in claim 1 wherein said second sealing means is carried in part by said cylindrical projectile and in part by said cylinder.

* * * * *